US005560848A

United States Patent [19]

Kim

[11] Patent Number: 5,560,848

[45] Date of Patent: Oct. 1, 1996

[54] COMBINATION DIPHENYL AMINE-PHENOTHIAZINE ADDITIVE FOR IMPROVED OXIDATION STABILITY IN POLYOL ESTER BASED GREASES (LAW236)

[75] Inventor: Jeenok T. Kim, Holmdel, N.J.

[73] Assignee: Exxon Research and Engineering Company, Florham Park, N.J.

[21] Appl. No.: 452,233

[22] Filed: May 26, 1995

[51] Int. Cl.[6] ..... C10M 133/38; C10M 123/00

[52] U.S. Cl. ..... 508/254

[58] Field of Search ..... 252/17, 47, 56 R, 252/56 S, 47.5, 50, 51.5 R

[56] References Cited

U.S. PATENT DOCUMENTS

| | | | |
|---|---|---|---|
| 2,791,560 | 5/1957 | Dilworth et al. | 252/51.5 R |
| 3,011,976 | 12/1961 | Cyba et al. | 252/51.5 R |
| 3,078,230 | 2/1963 | Cyba et al. | 252/51.5 R |
| 3,331,774 | 7/1967 | Saraceno | 252/32.5 |
| 3,585,137 | 6/1971 | Bosniack et al. | 252/32.5 |
| 3,663,438 | 5/1972 | Smith | 252/28 |
| 3,720,612 | 3/1973 | Bosniack et al. | 252/32.5 |
| 3,914,179 | 10/1975 | Byford et al. | 252/32.5 |
| 4,298,481 | 11/1981 | Clarke | 252/21 |
| 5,059,299 | 10/1991 | Cody et al. | 208/27 |
| 5,158,671 | 10/1992 | Cody et al. | 208/264 |
| 5,319,081 | 6/1994 | Spivack | 544/38 |
| 5,439,605 | 8/1995 | Khorramian | 252/47 |

FOREIGN PATENT DOCUMENTS

| | | |
|---|---|---|
| 1420824 | 1/1976 | United Kingdom . |
| 1438482 | 6/1976 | United Kingdom . |

*Primary Examiner*—Margaret Medley
*Attorney, Agent, or Firm*—Joseph J. Allocca

[57] ABSTRACT

The oxidation stability of polyol ester based lithium soap thickened greases is improved by use of a synergistic antioxidant combination comprising a mixture of (alkylated) diphenyl amine and phenothiazine.

7 Claims, No Drawings

COMBINATION DIPHENYL AMINE-PHENOTHIAZINE ADDITIVE FOR IMPROVED OXIDATION STABILITY IN POLYOL ESTER BASED GREASES (LAW236)

BACKGROUND OF THE INVENTION

1. Field of the Invention

The present invention is related to the improvement of the oxidation stability of polyol ester based, lithium soap thickened greases by use of combination antioxidant and to the greases containing such additives.

2. Description of the Related Art

The continued improvement in high efficiency equipment has placed a severe operating demand on the lubricants used in such equipment. High efficiency is, in most instances, achieved by designing the equipment to run at high speeds, higher temperatures, longer times between servicing, leaner fuel settings, etc., all of which increase the demands placed on the lubricants used. The severe performance demands placed on the lubricating greases operating at higher temperatures for longer times can be met primarily by improving the grease oxidation stability.

U.S. Pat. No. 4,298,481 discloses a high temperature grease composition comprising a base fluid that is a $C_{5-16}$ dialkyl ester of hydrogenated dimer acids that contain less than 8% by weight of trimer acids, an additive system and a thickener comprising an oleophilic surface-modified clay. The additive system consists of antioxidant, rust-inhibiting, metal passivating and load bearing components. The additive system is used in an amount in the range of 0.2 to 6 wt %. The system contains 0.1 to 2% of an antioxidant, said antioxidant being one or more aromatic amine antioxidant(s) alone or in combination with a hindered phenol, organic phosphate, alkyl thiodialkanoate and/or other conventional antioxidants. Suitable aromatic amine antioxidants include phenothiazine and substituted phenothiazines, diphenylamine, dinaphthylamine, p,p'-dioctyldiphenyl amine, etc. and mixtures thereof.

U.S. Pat. No. 3,663,438 discloses a high temperature grease composition comprising a mineral oil base stock thickened to grease consistency and incorporating minor amounts of a phenothiazine type oxidation inhibitor and a polyester of $C_1$-$C_{30}$ alcohol and $C_3$-$C_{20}$ carboxylic acids. The thickener used can include a wide variety of commonly accepted materials including soap-based thickeners, organic thickeners and clay thickeners.

U.S. Pat. No. 5,319,081 discloses substituted N-thiomethylphenothiazines as lubricant anti-oxidation stabilizers. The substituted N-thiomethylphenothiazine may be used in combination with other known antioxidant additives such as aromatic amines (e.g., p-tert octylphenyl-α-naphthylamines, p,p'-ditert octyl diphenylamines, 2,3-dihydro-3,3-dimethyl-4H-1,4 benzothiazine, phenothiazine, diphenylamine, etc.), hindered phenols, aliphatic or aromatic phosphates, esters of thiodipropionic or thiodiacetic acid, or salts of dithiocarbonic or dithiophosphoric acids. The patent broadly states that such antioxidant combinations may show a synergistic action and that such performance can be obtained when combining the substituted N-thiomethyl-phenothiazine of the patent with certain aromatic amines or hindered phenols or both. No direction is given as to how to select synergistic combinations nor are examples of synergistic combinations presented in the patent text.

GB 1,420,824 discloses functional fluids suitable for use as gas turbine lubricants and the base stocks for producing such fluids. The patent discloses the use of a particular synthetic ester base stock comprised of a mixture of a dialkyl ester of isophthalic acid and a synthetic ester selected from the diesters of aliphatic dicarboxylic acids and monohydric alcohols and the esters of monocarboxylic acid and polyhydric alcohols. The patent goes on to state that exceptional gas turbine lubricants can be formulated by incorporating into the ester base stock an antioxidant package comprising a phenothiazine or a substituted phenothiazine in combination with a diaryl amine.

GB 1,438,482 discloses lubricating oil additives impacting superior oxidation resistance to the resulting formulated oil. The additive is of the general formula R—X or R—Y—R where, in the case of the compound of formula R—X, R is a secondary amine residue containing two aromatic groups directly attached to nitrogen and X is an aliphatic hydrocarbon substituent containing 3 or 4 carbon atoms, which substituent is attached to a nitrogen atom of the group R and has an ethylenic or acetylenic linkage in the β-position to the nitrogen atom, and, in the case of a compound of formula R—Y—R, each R is independently as previously defined, and Y is an aliphatic hydrocarbon substituent containing 4 carbon atoms, which substituent is attached to a nitrogen atom of each group R and has an ethylenic or acetylenic linkage at the β-position to each nitrogen atom. A substituted phenothiazine of formula

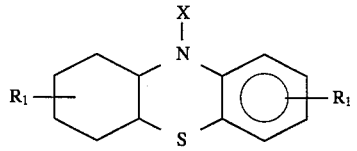

is described where X is an allyl or propangyl group and each $R_1$ is the same or different and is a hydrogen atom, a $C_4$-$C_{12}$ alkyl group or a $C_4$-$C_{12}$ alkoxy group provided that both $R_1$ groups are not hydrogen.

SUMMARY OF THE PRESENT INVENTION

The present invention is directed to a grease composition of improved oxidation stability comprising a polyol ester based base stock, a lithium soap thickener and a combination of phenothiazine and alkylated diphenylamine antioxidants. The polyol ester based lithium soap thickened grease composition may contain other additives such as conventional corrosion/rust inhibitors, metal passivators, viscosity index improvers, extreme pressure/anti wear additives widely known and used in the lubricating grease industry.

The dual additive combination of phenothiazine and alkylated diphenylamine antioxidants is employed in the formulated polyol ester based lithium soap thickened grease in a total amount in the range 0.1 to 1.5 wt %, preferably 0.2 to 1.2 wt %, most preferably 0.4 to 0.8 wt %.

In the antioxidant combination, (a) phenothiazine and the (b) alkylated diphenyl amine are present in an A/B weight ratio in the range 15:85 to 60:40, preferably 30:70 to 45:55, most preferably 50:50.

The composition of the present invention utilizes a polyol ester based base stock. As used herein and in the claims, the term polyol ester based base stock means a base stock which is either 100% polyol ester or which is a combination of polyol ester with a synthetic base oil produced by the isomerization of wax, hereinafter wax isomerate oil. In the combination polyol ester/wax isomerate oil base stock, the weight ratio of (I) polyol ester to (II) wax isomerate oil may range from 80:20 to 40:60, preferably 70:30 to 45:55, most preferably 50:50. In no instance, however, may the wax isomerate oil exceed 60% of the base stock used in preparing the grease composition.

By polyol ester is meant a base oil formed by the esterification of an aliphatic polyol with carboxylic acid. The aliphatic polyol reactant contains from 4 to 15 carbon atoms and has from 2 to 8 esterifiable hydroxyl groups. Examples of polyols are trimethylolpropane, pentaerythritol, dipentaerythritol, neopentyl glycol, tripent aerythritol and mixtures thereof.

The carboxylic acid reactant used to produce the synthetic polyol ester base oil is selected from aliphatic monocarboxylic acid or a mixture of aliphatic monocarboxylic acid and aliphatic dicarboxylic acid. The carboxylic acid contains from 4 to 12 carbon atoms and includes the straight and branched chain aliphatic acids.

The preferred polyol ester base oil is one prepared from technical pentaerythritol and a mixture of $C_4$-$C_{12}$ carboxylic acids. Technical pentaerythritol is a mixture which includes about 85 to 92% monopentaerythritol and 8 to 15% dipentaerythritol. A typical commercial technical pentaerythritol contains about 88% monopentaerythritol having the formula:

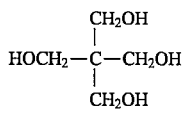

and about 12% of dipentaerythritol having the formula:

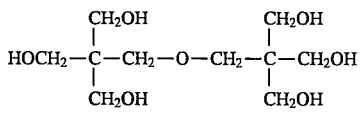

The technical pentaerythritol may also contain some tri and tetra pentaerythritol that is normally formed as by-products during the manufacture of technical pentaerythritol.

The preparation of esters from alcohols and carboxylic acids can be accomplished using conventional methods and techniques known and familiar to those skilled in the art. In general, technical pentaerythritol is heated with the desired carboxylic acid mixture optionally in the presence of a catalyst. Generally, a slight excess of acid is employed to force the reaction to completion. Water is removed during the reaction and any excess acid is then stripped from the reaction mixture. The esters of technical pentaerythritol may be used without further purification or may be further purified using conventional techniques such as distillation.

Wax isomerate is defined as the liquid product boiling in the lube oil boiling range of about 330° C. and higher and having a minimum viscosity of about 5.8 cSt @100° C. produced by the catalytic isomerization of material on synthetic wax, e.g. material wax obtained by the solvent or autorefrigerative solvent dewaxing of petroleum hydrocarbon, or synthetic wax obtained by the Fischer-Tropsch process. Processes describing the production of such wax isomerate and catalysts used in such production are presented in U.S. Pat. No. 5,059,299, U.S. Pat. No. 5,158,671.

The polyol ester or polyol ester/wax isomerate base stock is thickened using a lithium soap thickener.

Lithium complex soap is made in situ by first dissolving 9 to about 14 wt % of 12-OH stearic acid in the base stock and adding 2.1 to about 2.8 wt % LiOH monohydrate and 1.8–2.4 wt % of azelaic acid or 0.8–1.1 wt % boric acid.

The lithium soap thickener is used in an amount in the range 10 to 40 wt %, preferably 20 to 30 wt %, most preferably 12 to 22 wt %.

The phenothiazine-type component of the antioxidant combination which can be employed in the present invention is limited to unsubstituted phenothiazine.

Diphenyl amines useful in the present invention include diphenylamine per se and the di-alkyl derivatives of diphenyl amine, wherein the alkyl groups have from 1 to 12 carbon atoms. Thus, diphenyl amine, p,p'-dioctyldiphenyl amine, dihexyldiphenyl amine, didecyldiphenyl amine, didodecyl diphenyl amine are within the scope of materials contemplated as useful in the present invention.

As previously stated, the antioxidant combination is added to the grease in an amount in the range 0.1 to 1.5 wt %, preferably 0.2 to 1.2 wt %, most preferably 0.4 to 0.8 wt %, with the weight ratio of unsubstituted phenothiazine to diphenyl amine material being in the range 15:85 to 60:40, preferably 30:70 to 45:55, most preferably 50:50.

The formulated grease is produced conventionally. The polyol ester based base stock is combined with the lithium soap, the present antioxidant combination and any of the standard additives otherwise needed to achieve other desired performance characteristics. Examples of standard additives include corrosion/rust inhibitors, extreme pressure/antiwear additives and metal passivators which are introduced to the mixture in conventional concentrations, as needed or desired by the practitioner. Lubricating oil additives are described generally in "Lubricants and Related Products" by Dieter Klamann, Verlag Chemie, Deerfield Fla., 1984. The preparative techniques common to grease technology and well known to the art can be employed in producing the formulated grease. The performance of the grease is believed to be independent of the method of preparation and the sequence of component addition. Normally the lithium soap thickener is first formed in situ in the base stock and then the other additive components are blended in.

Example 1

The effectiveness of octylated diphenyl amine (ODA) and phenothiazine (Phe) as antioxidants was evaluated using high pressure (500 psi $O_2$) differential scanning calorimetry (HPDSC). ODA and Phe were used independently and then in combination in two polyol ester based greases thickened with different lithium soaps. The grease oxidation stability was determined in terms of induction time, corresponding to onset of accelerated oxidative breakdown of the grease. The results are presented in Table 1.

TABLE 1

| | | | HPDSC Induction Time, minutes | | |
|---|---|---|---|---|---|
| Grease | Thickener | HPDSC Temp. (°C.) | 0.5 wt % ODA | 0.5 wt % Phe | 0.25 wt % ODA/ 0.25 wt % Phe |
| 1 | Complex Li I | 210 | 15 | 20 | 50 |
| 2 | Complex Li II | 220 | 13 | 10 | 29 |

Grease #1 was made using a polyol ester having a viscosity of 6.2 cSt at 100° C., 31 cSt at 40° C. and a VI of 140 containing 13.6 wt % complex lithium soap comprising 12-hydroxy stearic acid, LiOH monohydrate and boric acid. Grease #2 was made of a 50/50 mixture of two polyol esters, the first being the same as in Grease #1 and the second being a polyol ester having a viscosity of 21 cSt at 100° C., 164 cSt at 40° C. and a VI of 150. Grease #2 contained 13 wt % complex lithium soap comprising 12-hydroxy stearic acid, LiOH monohydrate and azelaic acid.

From Table 1, it is seen that the combination ODA/Phe produces an improvement in oxidation stability greater than that attributable to either component alone, and greater than the sum if one added the contribution of each component together, with the total combination ODA/Phe treat rate equivalent to that of either ODA or Phe alone.

Example 2

This Example demonstrates that the synergistic performance of the diphenylamine/phenothiazine antioxidant combination is unexpectedly dependent on both the nature of the base stock and on the identity of the thickener used to produce the grease.

The synergy between ODA and Phe was tested using several other base greases formulated with different thickeners and base oils from those used in Example 1. In Table 2, the mineral oil is a SN600 oil. The wax isomerate has a viscosity of 5.8 cSt at 100° C., 29.6 cSt at 40° C. and a VI of 142, while the polyol ester is one having a viscosity of 21 cSt at 100° C., 164 cSt at 40° C. and a VI of 150. The complex lithium thickener is the saponification product of 12-hydroxy stearic acid, azelaic acid and LiOH monohydrate whose total concentration ranges from 15 to 18 wt %.

Table 2 illustrates the specificity of the ODA/Phe synergy to base grease composition. No enhancement in grease oxidation stability was obtained when the thickener was changed to a polyurea or the base oil to mineral oil or wax isomerate. However, the ODA/Phe synergy was exhibited in the 50/50 mixed polyol ester/wax isomerate-based grease with a complex Li thickener.

TABLE 2

| | | | HPDSC Induction Time, minutes | | |
|---|---|---|---|---|---|
| Grease | Thickener | HPDSC Temp. (°C.) | 0.5 wt % ODA | 0.5 wt % Phe | 0.25 wt % ODA/ 0.25 wt % Phe |
| Mineral | Complex Li | 180 | 12 | 21 | 11 |
| Wax Isomerate | Complex Li | 190 | 21 | 27 | 22 |
| Polyol Ester | Polyurea (27.5 wt %) | 250 | 12 | 8 | 11 |
| Polyol Ester/ Wax Isomerate | Complex Li | 200 | 6 | 10 | 28 |

Example 3

This example illustrates that control of the ratio of diphenylamine to phenothiazine is important to the successful practicing of the present invention. Various ratios of diphenyl amine to phenothiazine were employed in a polyol ester based grease. The base stock was a 50/50 mixture of polyol esters, the first having a viscosity of 6.7 cSt at 100° C. (VI 140) and the second having a viscosity of 21 cSt at 100° C. (VI 150). Other experiments involved the use of other forms of secondary amines such as phenyl-alpha naphthylamine, or octyl diphenyl amine (ODA) linked to benzotriazole. Substituted phenothiazine was also evaluated. The greases contained 13 wt % complex lithium soap comprising 9% 12-hydroxy stearic acid, 1.8% azelaic acid and 2.1% LiOH monohydrate.

The experimental data are presented in Table 3.

TABLE 3

| Antioxidant | HPDSC Induction Time @ 220° C. (minutes) |
|---|---|
| 0.3 wt % ODA + 0.3 wt % Phe | 46 |
| 0.5 wt % ODA + 0.1 wt % Phe | 40 |
| 0.1 wt % ODA + 0.5 wt % Phe | 15 |
| .6 wt % Phe | 13 |
| .6 wt % ODA | 26 |
| 0.5 wt % ODA + 0.1 wt % alkylated phenothiazine | 12 |
| 0.5 wt % PANA[1] + 0.1 wt % Phe | 14 |
| 0.5 wt % BT 63[2] + 0.1 wt % Phe | 18 |

[1]phenyl alpha naphthylamine
[2]ODA linked to benzotriazole

From this it is clear that the wt. ratio of phenothiazine to diphenylamine must not exceed 60:40 and that only the unsubstituted phenothiazine and diphenylamine can be used in the present synergistic mixture.

What is claimed is:

1. A grease composition of improved oxidation stability comprising a polyol ester based base stock, a complex lithium soap thickener and a combination of unsubstituted phenothiazine and alkylated diphenylamine, wherein the combination of unsubstituted phenothiazine and alkylated diphenylamine is present in a total amount in the range 0.1 to 1.5 wt % and the ratio of unsubstituted phenothiazine to alkylated diphenylamine is in the range 15:85 to 60:40.

2. The composition of claim 1 wherein the combination phenothiazine and alkylated diphenylamine is present in the grease in a total amount in the range 0.2 to 1.2 wt %.

3. The composition of claim 1 wherein the combination phenothiazine and alkylated diphenylamine is present in the grease in a total amount in the range 0.4 to 0.8 wt %.

4. The composition of claim 1, 2, or 3 wherein the ratio of phenothiazine to diphenylamine is in the range 30:70 to 45:55.

5. The composition of claim 1, 2, or 3 wherein the polyolester based base stock is 100% polyolester.

6. The composition of claim 1, 2, or 3 wherein the polyolester based base stock is a combination of polyolester and wax isomerate oil wherein the wax isomerate oil constitutes 60 wt % or less of the combination.

7. The composition of claim 1, 2, or 3 wherein the lithium soap thickener is present in an amount in the range 10 to 40 wt %.

* * * * *